United States Patent [19]

Lostumo et al.

[11] 4,387,947

[45] Jun. 14, 1983

[54] HIGH VOLTAGE CONNECTOR

[75] Inventors: Arthur J. Lostumo, Franklin Park; Steven J. Pulchinski, Northbrook, both of Ill.

[73] Assignee: Zenith Radio Corporation, Glenview, Ill.

[21] Appl. No.: 278,160

[22] Filed: Jun. 29, 1981

[51] Int. Cl.[3] ..... H01R 13/625

[52] U.S. Cl. ..... 339/90 R; 339/94 R; 339/202; 339/203

[58] Field of Search ..... 339/90 R, 90 C, 94 R, 339/94 A, 94 C, 94 M, 252 S, 200, 201, 202, 203

[56] References Cited

U.S. PATENT DOCUMENTS

| | | | |
|---|---|---|---|
| 2,241,419 | 5/1941 | Peters | 339/94 C |
| 3,824,526 | 7/1974 | Glover | 339/94 R |
| 3,842,390 | 10/1974 | Glover et al. | 339/94 R |
| 3,941,928 | 3/1976 | Gaind | 178/7.8 |
| 4,019,796 | 4/1977 | Issler et al. | 339/252 S |
| 4,343,526 | 8/1982 | Hobson et al. | 339/90 R |

*Primary Examiner*—John McQuade

[57] ABSTRACT

A high voltage disconnect plug and a receptacle therefor are described for use in coupling a high voltage conductor to a load such as a CRT. The plug includes a lock nut and a deformable annular ring through which the conductor passes, and a hollow sleeve which slides over the conductor to capture the ring between the sleeve and the lock nut. A spring carried by the sleeve engages a contact on an end of the conductor which passes through the sleeve. Insertion of the plug into a bore in the receptacle compresses the spring between the conductor's contact and a high voltage contact in the bore for coupling high voltage to the latter contact. Locking the nut to the receptacle deforms the ring to tightly seal it against the receptacle's inner wall around the bore.

3 Claims, 3 Drawing Figures

HIGH VOLTAGE CONNECTOR

BACKGROUND OF THE INVENTION

This invention is directed to improvements in high voltage disconnect plugs of the type used to couple a television receiver's high voltage to the receiver's cathode ray tube.

Television projection systems typically include a television receiver, three CRTs (cathode ray tubes), and a screen on which the images developed by the CRTs are projected. High voltage for the CRTs is usually developed in the receiver and coupled to the CRTs via three separate high voltage plugs.

Referring to FIG. 1, a typical plug 10 is shown for coupling high voltage carried by an insulated wire 12 to a single CRT. The illustrated plug includes a lock nut 14, an annular rubber seal 16, a hollow spacer 18, and a sleeve 20. The end of the wire 12 includes a metal crimp 22 which makes contact with an inner conducter in the wire 12.

When the plug 10 is assembled, the sleeve 20 fits over the spacer 18 so that its end 24 engages and locks with the lock nut 14. In this condition, it is intended that the crimp 22 contact a screw 26 which protrudes into the sleeve 20, and that the seal 16 be tightly captured by the inner surface of the sleeve 20 where the sleeve engages the lock nut.

The plug 10 has been found to have several disadvantages. Specifically, the contact pressure between the crimp 22 and the screw 26 depends on how tightly the sleeve locks with the lock nut 14. The effectiveness of the seal 16 also depends on how tightly the lock nut holds the sleeve 20. If manufacturing tolerances are not fairly rigid, the sleeve 20 may be only loosely held by the lock nut 14, thereby allowing the crimp 22 to come out of contact with the screw 26. In addition, the possibility is increased of a high voltage arc jumping between the crimp 22 and a portion of the uncovered part of the wire 12 which may contact chassis ground. The latter problem is due at least partly to the failure of the sleeve 20 to tightly engage the seal 16, thereby providing a path for a high voltage arc. These problems also arise when the plug is subject to ambient temperatures which cause the lock nut and/or the sleeve 20 to expand or deform. For these reasons, high voltage plugs of this type are generally unsatisfactory.

OBJECTS OF THE INVENTION

It is a general object of the invention to provide an improved high voltage disconnect assembly.

It is another object of the invention to provide a disconnect plug which is less subject to high voltage arcs and which provides more reliable contact with the high voltage than conventional plugs.

BRIEF DESCRIPTION OF THE FIGURES

The objects stated above and other objects of the invention are set forth more particularly in the following detailed description of the accompanying drawings in which.

DESCRIPTION OF THE PREFERRED EMBODIMENT

The disconnect plug described herein is adapted to be inserted into a special high voltage receptacle which provides a disconnectable interface between the plug and a load such as the anode of the CRT. The components of the plug itself are shown in FIG. 2, and the way in which the plug mates with the high voltage receptacle is shown in FIG. 3.

Figure 1:
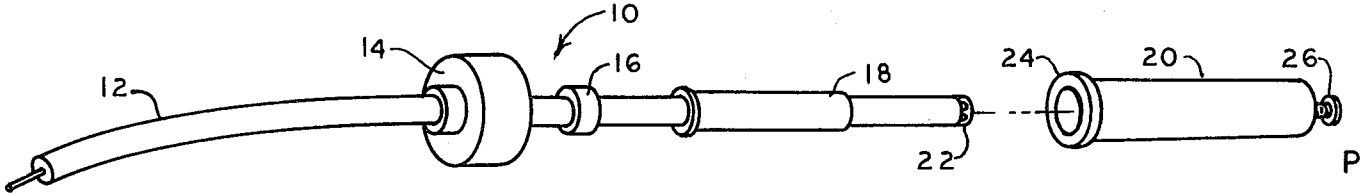
FIG. 1 PRIOR ART
FIG. 1, previously described, is an exploded view of a conventional high voltage disconnect plug.
Figure 2:
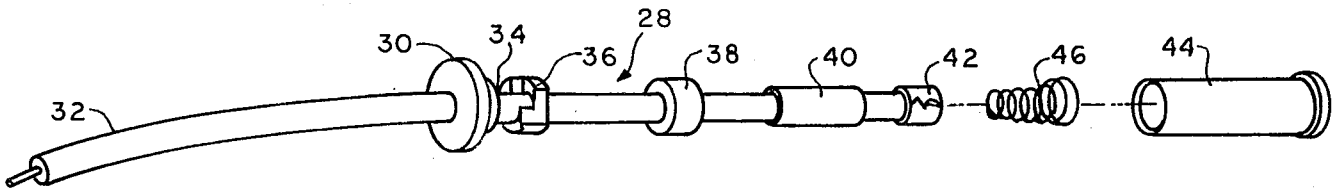
FIG. 2 is an exploded view of a preferred embodiment of a high voltage disconnect plug according to the invention.
Figure 3:
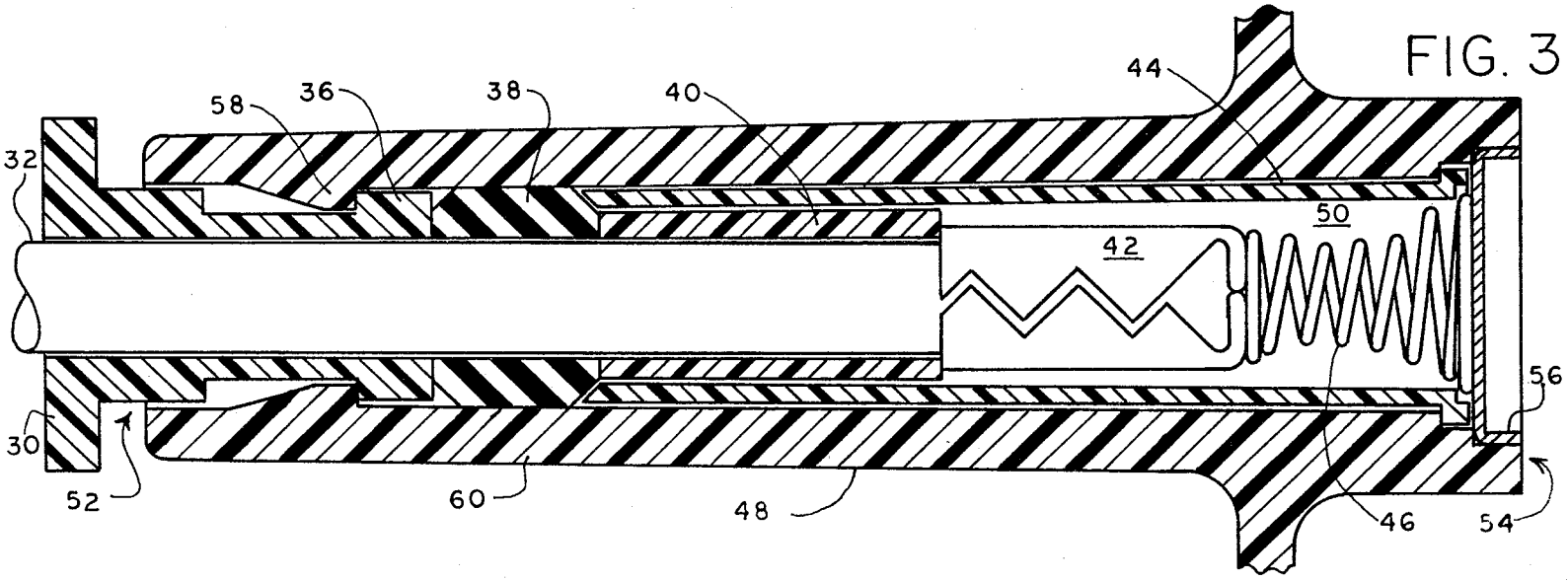
FIG. 3 is a sectional view of the plug shown in FIG. 2 and a high voltage receptacle with which the plug is mated.

Referring first to FIG. 2, the plug 28 includes a lock nut 30 having a central aperture through which an insulated high voltage conductor 32 passes. Molded into the barrel 34 of the plug is a raised boss 36 which acts as a locking mechanism for locking the plug to the high voltage receptacle.

A deformable annular ring 38, made of rubber, for example, also has a central aperture through which the conductor 32 passes. As described in more detail below, the function of the ring 38 is to provide a tight seal with the high voltage receptacle.

Adjacent the ring 38 is a hollow, generally cylindrical spacer 40 through which the conductor 32 passes. This spacer is fairly rigid and may be constructed of plastic, for example, for supporting the conductor along its axial dimension.

The end of the conductor which passes through the spacer 40 carries an electrical contact which is preferably in the form of a metal crimp 42. Electrical connection between the crimp and the inner wire of the conductor 32 may be accomplished by soldering the crimp to the wire.

The plug further includes a sleeve 44 and a spring 46. The sleeve is hollow and fairly rigid, and dimensioned to fit over the spacer 40 for abutting the ring 38. The spring 46 is normally carried inside the sleeve 44 so that, when the sleeve is positioned around the spacer 40, the spring 46 contacts the crimp 42.

Referring now to FIG. 3, a section is shown of a high voltage receptacle 48 mating with the plug 28. Formed in the receptacle 48 is a relatively long, cylindrical bore 50, having an open end 52 for receiving the plug and an opposite end 54 which carries a high voltage contact in the form of a retainer cup 56.

When the plug is inserted in the bore 50 as shown, twisting of the lock nut 30 engages its boss 36 with an inward projection 58 molded into the sidewall 60 of the receptacle. Thus, the plug is locked to the receptacle. In this condition, the ring 38 is firmly captured between the sleeve 44 and the lock nut, and the sleeve presses against the ring to slightly deform it outwardly so that a tight seal is established between the outer circumference of the ring and the inner sidewall 60. In addition, the spring 46 is compressed between the crimp 42 and the retainer cup 56. With this arrangement, electrical connection is established between the inner wire of the conductor 32 and the retainer cup via the crimp 42 and the spring 46. Any suitable contact or connector (not shown) may couple high voltage from the retainer cup to the anode of a CRT.

One advantage of this disconnect system is that manufacturing tolerances or component expansion which causes the plug to be somewhat loosely engaged with the high voltage receptacle do not cause a loss of high voltage at the retainer cup. The spring 46 merely expands axially to compensate for any such looseness and maintains an electrical connection between the crimp 42 and the retainer cup. In addition, the tight seal effected between the ring 38 and the sidewall 60 reduces the chance of high voltage arc jumping from the area of the crimp or spring to a portion of the conductor 32 which leads into the plug when that portion of the conductor touches ground potential.

When it is desired to remove the high voltage from the retainer cup, the plug is easily disconnected from the high voltage receptacle by twisting the lock nut to disengage it from the projection 58, and pulling the plug out of the bore.

From the foregoing description, it will be apparent that the plug and high voltage receptacle may be used in a variety of applications where it is desirable to selectively connect and disconnect high voltage from any type of load. They are particularly useful in television projection systems having three CRTs whose anodes require high voltage. In this application, the high voltage receptacle may include three bores, each carrying its own retainer cup for coupling high voltage to a CRT. Each such bore would receive a single plug of the type described above.

Although the invention has been described in terms of a preferred embodiment, it will be obvious to those skilled in the art that many alterations and modifications may be made without departing from the invention. Accordingly, it is intended that all such modifications and alterations be considered as within the spirit and scope of the invention as defined by the appended claims.

What is claimed is:

1. A disconnect plug for coupling a high voltage conductor to a high voltage receptacle having a bore for receiving the plug and a high voltage contact therein, comprising:

a lock nut having a central aperture for receiving the conductor and a mechanism for locking the nut to the high voltage receptacle;

a deformable annular ring adapted to slip over the conductor in a position adjacent the lock nut;

a generally cylindrical, hollow sleeve adapted to slide over the conductor for pressing the ring against the lock nut;

an electrical contact on an end of the conductor which extends through the sleeve;

an electrically conductive spring carried within the sleeve for engaging the conductor's contact such that, when the plug is inserted into the bore in the high voltage receptacle, the spring engages the high voltage contact therein and is compressed between the latter contact and the conductor's contact, and when the lock nut is locked to the high voltage receptacle, the sleeve deforms the ring into a tight fit with an inner surface of the bore.

2. A plug as set forth in claim 1 including a generally cylindrical, hollow spacer adapted to fit over the conductor between the ring and the conductor's contact, and dimensioned to fit within the sleeve.

3. A high voltage disconnect assembly for use in a television system, comprising:

a high voltage receptacle having an inner surface which defines a bore for receiving a disconnect plug therein, and having a high voltage contact seated in the bore; and a disconnect plug including;

a lock nut having a central aperture for receiving the conductor and a mechanism for locking the nut to the high voltage receptacle;

a deformable annular ring adapted to slip over the conductor in a position adjacent the lock nut;

a hollow spacer adapted to fit over the conductor adjacent the ring;

a hollow sleeve adapted to slide over the conductor and the spacer for pressing the ring against the lock nut;

a crimp contact on an end of the conductor which extends through the sleeve; and an electrically conductive spring carried within the sleeve for engaging the crimp contact such that, when the plug is inserted into the bore and locked to the high voltage receptacle by means of the lock nut, the spring engages the high voltage contact therein and is compressed between the crimp contact and the high voltage contact, and the sleeve deforms the ring to a tight fit with the inner surface of the bore.

* * * * *